US011745037B2

(12) United States Patent
Lewonig et al.

(10) Patent No.: US 11,745,037 B2
(45) Date of Patent: Sep. 5, 2023

(54) OPEN-LOOP AND CLOSED-LOOP CONTROL SYSTEM OF A DEOXYGENATION PLANT

(71) Applicant: Wagner Group GmbH, Langenhagen (DE)

(72) Inventors: Horst Lewonig, Hannover (DE); Andreas Henkel, Harsum (DE)

(73) Assignee: Wagner Group GMBH, Langenhagen (DE)

( * ) Notice: Subject to any disclaimer, the term of this patent is extended or adjusted under 35 U.S.C. 154(b) by 123 days.

(21) Appl. No.: 17/055,091

(22) PCT Filed: May 9, 2019

(86) PCT No.: PCT/EP2019/061910
§ 371 (c)(1),
(2) Date: Nov. 12, 2020

(87) PCT Pub. No.: WO2019/219494
PCT Pub. Date: Nov. 21, 2019

(65) Prior Publication Data

US 2021/0121723 A1 Apr. 29, 2021

(30) Foreign Application Priority Data

May 14, 2018 (EP) ..... 18020204

(51) Int. Cl.
*A62C 99/00* (2010.01)
*A62C 3/00* (2006.01)

(52) U.S. Cl.
CPC ..... *A62C 99/0018* (2013.01); *A62C 3/00* (2013.01)

(58) Field of Classification Search
CPC .... A62C 2/00; A62C 2/04; A62C 3/00; A62C 99/0018
(Continued)

(56) References Cited

U.S. PATENT DOCUMENTS 5,058,004 A 10/1991 Ravid
6,739,399 B2 * 5/2004 Wagner ..... A62C 99/0018 169/45
(Continued)

FOREIGN PATENT DOCUMENTS

AU 1999027258 A1 12/1999
CN 105705206 A 6/2016
(Continued)

OTHER PUBLICATIONS

PCT Notification of Transmittal of the International Search Report and the Written Opinion of the International Searching Authority, or the Declaration, International Searching Authority, International Application No. PCT/EP2019/061910, dated Jun. 19, 2019, 13 pages.
(Continued)

*Primary Examiner* — Steven J Ganey
(74) *Attorney, Agent, or Firm* — Cesari and McKenna, LLP

(57) ABSTRACT

The invention relates to a control and regulating system of an oxygen-reducing system, comprising at least one inert gas generator (30*a*, 30*b*), at least one oxygen concentration sensor (31*a*, 40), at least one actuator (32, 33, 41) for releasing inert gas, wherein the control and regulating system comprises a plurality of signal-connected controller modules (22, 24), each configured or configurable so as to enable the execution of one or more regulating functions, wherein the regulating functions are decentrally distributed to at least two signal-connected controller modules (22, 24).

19 Claims, 11 Drawing Sheets

Figure 1A:
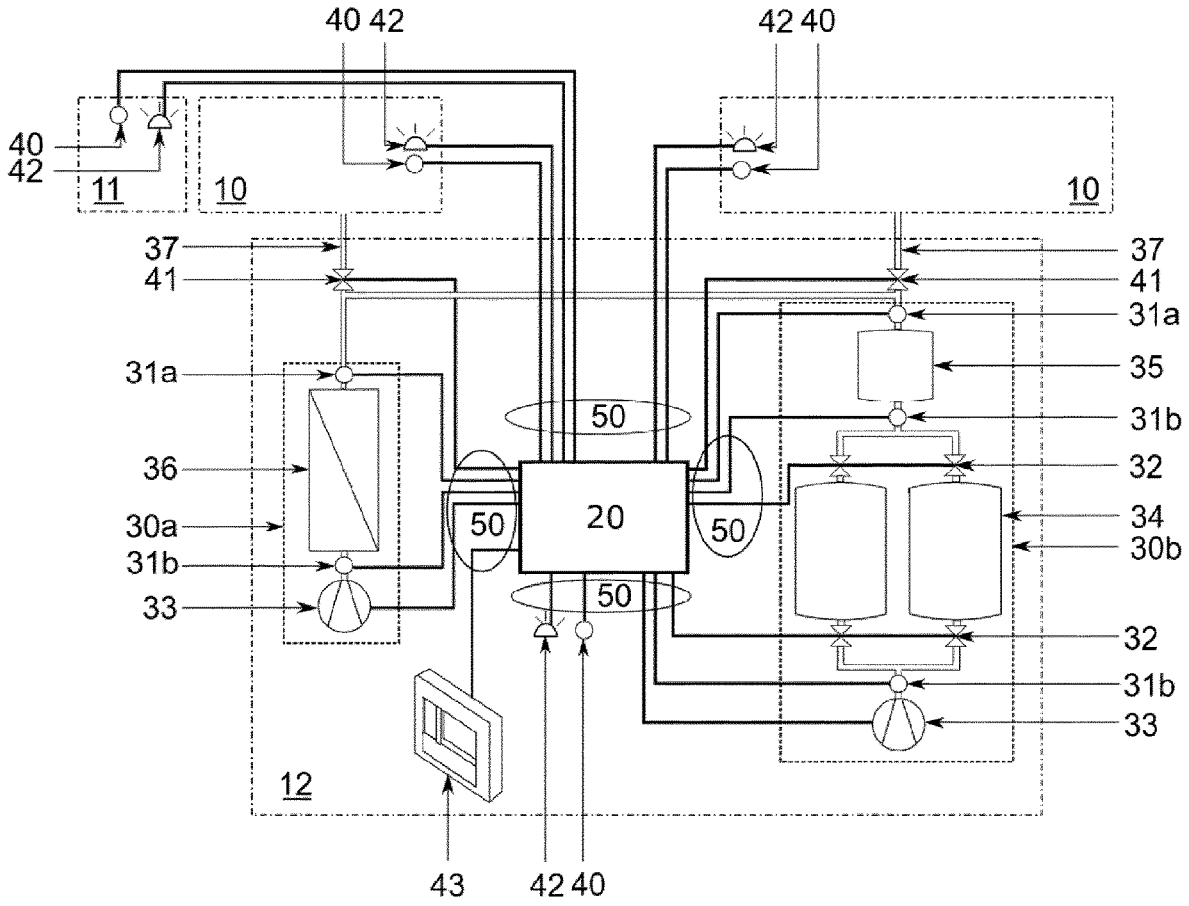
Fig. 1a Prior Art

(58) Field of Classification Search
USPC ..... 169/45, 46, 54, 62
See application file for complete search history.

(56) References Cited

U.S. PATENT DOCUMENTS

| | | | | |
|---|---|---|---|---|
| 8,517,116 | B2 | 8/2013 | Wagner | |
| 9,364,698 | B2 | 6/2016 | Wagner | |
| 9,861,842 | B2 * | 1/2018 | Wagner | A62C 99/0018 |
| 2006/0272579 | A1 | 12/2006 | Nakao | |
| 2007/0151454 | A1 | 7/2007 | Marwitz et al. | |
| 2009/0038811 | A1 * | 2/2009 | Wagner | A62C 99/0018 169/46 |
| 2013/0126193 | A1 | 5/2013 | Gupta | |
| 2017/0173373 | A1 | 6/2017 | Wagner et al. | |
| 2018/0001124 | A1 | 1/2018 | Klassen et al. | |

FOREIGN PATENT DOCUMENTS

| | | | |
|---|---|---|---|
| CN | 107690343 | A | 2/2018 |
| CN | 108430592 | A | 8/2018 |
| DE | 69010822 | | 3/1995 |
| DE | 102009030703 | B4 | 1/2016 |
| EP | 1930048 | A1 | 12/2006 |
| ES | 2617753 | T3 | 6/2017 |
| JP | H07154391 | A | 6/1995 |
| RU | 58761 | U1 | 11/2006 |
| RU | 113855 | U1 | 2/2012 |
| WO | WO-1995001041 | A1 | 1/1995 |

OTHER PUBLICATIONS

EP Office Action dated Mar. 2, 2022, EP Application No. 18 020 204.6, 8 pages.

Translation of CN First Office Action, CN Application No. 201980031853.2, 14 pages.

Office Action dated Jun. 8, 2022 in Russian patent application No. 2020140109, pp. 8-9.

* cited by examiner

OPEN-LOOP AND CLOSED-LOOP CONTROL SYSTEM OF A DEOXYGENATION PLANT

CROSS REFERENCE TO RELATED APPLICATIONS

This application is the National Stage of International Application No. PCT/EP2019/061910, filed May 9, 2019, which claims the benefit of European Patent Application No. 18020204.6 filed on May 14, 2018. The contents of both applications are hereby incorporated by reference in their entirety.

The invention relates to a control and regulating system of an oxygen-reducing system. The invention further relates to an oxygen-reducing system having such a control and regulating system as well as a method for controlling and/or regulating an oxygen-reducing system.

In practice, oxygen-reducing systems are often used to prevent and avoid fires. These systems enable reducing the oxygen content within a protected area to a level which is below the flammability limit of the materials. The oxygen concentration is lowered by feeding inert gases or inert gas-enriched air, in particular nitrogen or nitrogen-enriched air, into the protected area. The ratio of inert gas or inert gas-enriched air to oxygen is thus regulated so as to result in the oxygen content of the air within the protected area being reduced. While doing so, there is still enough oxygen for people to be able to remain in the protected area.

Various components are provided to control such an oxygen-reducing system. An inert gas source, for example an inert gas generator, constitutes the key component of an oxygen-reducing system. Such an inert gas generator is described below in this application as a nitrogen generator which typically separates compressed ambient air into a nitrogen-enriched airflow and an oxygen-enriched airflow. The nitrogen-enriched airflow can have a nitrogen content of for example between 90.0 and 99.9% and is used to lower the oxygen content in the protected area. The operation of such nitrogen generators can be based on the principle of membrane gas separation or pressure swing adsorption (e.g. PSA "Pressure Swing Adsorption" or VPSA "Vacuum Pressure Swing Adsorption"). Furthermore, controlling an oxygen-reducing system requires at least one oxygen concentration sensor determining the oxygen content in the protected area. Lastly, at least one actuator, for example a valve or a relay, is typically provided for switching on and off a compressor assigned to the nitrogen generator so as to control the introduction of the generated nitrogen or nitrogen-enriched air respectively into the protected area. Additional optional components of an oxygen-reducing system are, for example, visual or acoustic means of alarm to alert persons who may in the vicinity in case of alarm, for example if the oxygen concentration in the protected area drops below a threshold value.

In order to reach a predetermined oxygen level, it is customary to regulate the oxygen-reducing system's individual components. A control center is usually provided to that end which on the one hand is connected to the nitrogen generators and regulates the generation of nitrogen as required. On the other hand, the control center is connected to the oxygen concentration sensors in order to process the values they determine and relay the corresponding nitrogen volume requirements to the nitrogen generators. The control center can regulate several protected areas independently of one another, whereby each protected area is assigned one or more nitrogen generators and one or more oxygen concentration sensors is located in each protected area. Furthermore, the control center is coupled to multiple actuators in order to control the distribution of the generated nitrogen into the protected rooms.

As the complexity of oxygen-reducing systems increases, for example in buildings with large protected areas or a large number of protected areas such as e.g. in factories, warehouses and archives, the challenge becomes safely and reliably controlling all of the components of the oxygen-reducing system. The control center must be designed with high computing power and numerous interfaces to befit the plurality of connected nitrogen generators, oxygen concentration sensors and actuators; moreover, installation and maintenance as well as troubleshooting in the event of malfunctions become very complicated as system size increases. Even just laying the at times very long power supply and signal lines between all the components and the control center is labor and cost-intensive. Standard-compliant line monitoring of all power supply lines for creeping interruptions or creeping short circuits is also more difficult to implement with an increasing number of lines and longer line lengths. Retrofitting and expanding the oxygen-reducing system also poses a complex task in terms of wiring and reconfiguration. Additionally constituting a challenge in the control of oxygen-reducing systems to the present point in time is the implementation of efficient energy management and the high degree of system stability required by fire protection regulations.

The task of the invention is therefore the specifying of a control and regulating system of an oxygen-reducing system which offers reduced manufacturing, installation and maintenance costs, ensures greater system stability and improved energy management and is flexibly adaptable and expandable. A further task of the invention is that of specifying an oxygen-reducing system having such a control and regulating system as well as presenting an operating method for same.

According to the invention, this task is solved with regard to the control and regulating system by the subject matter of claim 1. With regard to the oxygen-reducing system and the operating method, the task is solved by the subject matter of claims 15 and 16.

The invention is thus based on the idea of specifying a control and regulating system of an oxygen-reducing system for lowering and maintaining an oxygen concentration level in at least one enclosed protected area which comprises at least one inert gas generator, at least one oxygen concentration sensor and at least one actuator for releasing inert gas. The control and regulating system comprises a plurality of signal-connected controller modules. Each controller module is preferably configured or configurable so as to enable the execution of one or more regulating functions. The regulating functions are thereby decentrally distributed to at least two signal-connected controller modules.

The invention is insofar based on the basic concept of using standardized controller modules, wherein the controller modules can be assigned different functions. This provides a modularity which enables the control and regulating system to be readily and quickly adapted to different requirements, particularly to differently sized or multiple protected areas, yet also to oxygen-reducing systems of differing complexity. In addition to the flexibility thereby gained and the facilitated certification of systems with standardized components, the structure and functioning of a controller module specialized to specific functions is simplified compared to the structure and functioning of a broadly based control center. Subsequent system expansions, modifications or minimizations can thereby also be implemented with little effort. The controller modules can be produced and programmed more easily as standard assemblies and they also require less space at their respective site of operation. The controller modules can be serviced and replaced more easily without affecting the overall function of the oxygen-reducing system. The power supply and signal lines can be consolidated into strands, which for example simplifies line monitoring. The decentralized distribution of control and regulating functions additionally increases system stability since a controller module malfunction, for example, has less of an impact on the oxygen-reducing system's overall function.

In terms of hardware, the individual controller modules can be of largely identical design. In particular, each of the controller modules can have respectively identical controllers. However, the controller modules can at least partly differ in their interfaces so as to be able to, for example, be optimally connected in terms of signals to different types of actuators such as valves and alarm means or to oxygen concentration sensors of the protected area. These differing interfaces can be provided in addition to an identical basic set of interfaces common to all the controller modules. By the controller modules each being able to assume different regulating functions, the controller modules can be modularly combined with one another. The modularity inasmuch results from being able to assemble different combinations of controller modules in order to individually distribute different functions for operating the oxygen-reducing system to said combinations.

The regulating functions able to be implemented on the controller modules can differ. Particularly the monitoring of the oxygen concentration in a protected area, the generating of a corresponding amount of inert gas and the releasing of the generated volume of inert gas into the protected area to regulate the oxygen concentration therein are key functions which are in any case able to be provided in the control and regulating system and distributed across different controller modules. Particularly in the case of an oxygen-reducing system having a plurality of protected areas, the decentralized distribution of regulating functions enables a redundancy and expandability which is unable to be easily realized in the case of previous centrally controlled systems.

To clarify, it is pointed out in this context that the controller modules are not only able to perform regulating functions; i.e. functions having a signal feedback-influenced or influenceable manipulated variable, but also control functions. The terms "controller module" and "regulating function" are insofar to be understood as abbreviated versions of the terms "control and regulating module" as well as "control and regulating function" in the context of the present application.

One preferential embodiment of the invention provides for the controller modules to be modularly combinable with one another. The controller modules can thereby each be differently configured or configurable by appropriate user inputs via an input interface. All conceivable human/machine interfaces are feasible as the input interface, for example a touch control panel integrated into the controller module, a USB interface for importing a configuration file from a support PC, or even for example DIP or rotary switches. Essentially, any plurality of largely similar controller modules can thus be signal-connected to one another as desired. The respectively required or desired regulating function can be assigned to the individual controller modules through the appropriate configuration.

A further preferential embodiment of the invention provides for the controller modules to each be configured or configurable such that at least one of the following regulating functions can be performed by at least one controller module:

a) control/regulation of the inert gas generation, particularly by
- switching on and off the at least one inert gas generator and/or
- evaluating sensor signals, in particular of the at least one oxygen concentration sensor and/or further gas, temperature, volumetric flow and/or pressure sensors assigned to the at least one inert gas generator and/or
- activating actuators of the at least one inert gas generator;

b) monitoring an oxygen concentration level in an enclosed monitored area and/or control/regulation of an oxygen concentration level in at least one enclosed protected area, particularly by
- evaluating sensor signals, in particular the at least one oxygen concentration sensor and/or further gas, temperature, volumetric flow and/or pressure sensor signals from the sensors arranged in the at least one enclosed monitored/protected area and/or evaluating signals from door contacts arranged in the monitored/protected area and/or
- requisitioning an amount of inert gas from the at least one inert gas generator and/or
- activating actuators in the at least one enclosed monitored/protected area and/or
- activating displays in or on the at least one enclosed monitored/protected area, particularly to display oxygen concentration measurement values and/or
- activating acoustic and/or visual means of alarm in case of alarm;

c) coordination of the communication between components of the oxygen-reducing system and/or coordination of the communication to points external of the oxygen-reducing system, particularly by
- distributing demands for inert gas quantities to a plurality of inert gas generators according to predefined criteria and/or
- distributing generated inert gas to a plurality of enclosed protected areas according to predefined criteria and/or
- collecting and evaluating at least one status, failure and/or alarm signal of at least one controller module and/or
- generating at least one status, failure and/or alarm message, particularly for display on a control unit and/or for forwarding to an external, in particular continually manned, location and/or
- activating displays, particularly to display sensor measurement values and/or
- providing remote access to the oxygen-reducing system.

Further optional regulating functions include, for example, the distribution of the produced inert gas into multiple protected areas, the purely precautionary monitoring of the oxygen concentration in adjacent, utility, machine and service rooms without inert gas introduction to regulate the oxygen concentration, the monitoring of ambient conditions, e.g. weather parameters outside the protected and monitored areas, the alerting upon dangerous environmental conditions in protected or monitored areas, the controlling of the display and/or the notifying of malfunctions in the oxygen-reducing system. The individual regulating functions can thereby be decentrally distributed to different controller modules. In particular, individual controller modules can perform a plurality of the aforementioned regulating functions, for example in order to create redundancy. Doing so ensures a particularly high level of operational reliability.

Generally speaking, a process controller for the controlling or respectively regulating of the inert gas generation, an area controller for monitoring an oxygen concentration level in an enclosed monitored area and/or for controlling/regulating an oxygen concentration level in at least one enclosed protected area and/or a master controller for coordinating the communication between controller modules and/or other components of the oxygen-reducing system and/or for coordinating communication to points external the oxygen-reducing system can be provided as controller modules. The assignment of the controller module as an area controller, process controller or master controller preferably ensues through customer-specific configuration. In other words, the area controller, the process controller and the master controller can essentially have the same structure, whereby the controller module is assigned regulating functions by means of user input so that the controller module functions as an area controller, process controller or master controller. The regulating functions can be assigned upon initial start-up or even during operation of the oxygen regulating system.

Thus, two controller modules can for example be provided in a control and regulating system, whereby one controller module which is arranged in a protected area is assigned the function of area controller. Another controller module which is arranged on the inert gas generator can be assigned a process controller function. This assignment can be made after the controller modules have been installed so that attention does not need to be paid during installation as to which controller module is installed at a specific location. This simplifies the installation process and reduces costs. In addition, the controller modules can be quickly and easily exchanged, whereby storage costs are reduced. Lastly, this architecture also enables easy and efficient expandability of the control and regulating system. For example, a further protected area can thus be subsequently added, whereby only one further controller module which then assumes the function of a further area controller thereby needs to be installed. A further nitrogen generator provided with a further controller module, which then assumes the function of a further process controller, can for example also be added. Further controller modules can also be added independently of a system expansion, e.g. to supplement an existing controller module in terms of n+1 redundancy and thereby further increase the reliability of the system. Each further controller module can be accordingly configured by means of user input. (Re)programming is not necessary; in fact, all controller modules have the same basic programming so that regulating functions can be assigned quickly and easily during installation.

The invention preferentially provides for the individual controller modules to be signal-connected to one another such that there is an exchange of data. The individual controller modules can thus coordinate with each other, for example in controlling the generation of inert gas depending on the demands made by the different area controllers.

In one preferential configuration of the inventive control and regulating system, a plurality of monitored and/or protected areas are provided, wherein at least one area controller is assigned to each protected area for controlling or respectively regulating an oxygen concentration level in the protected area. Alternatively or additionally, at least one area controller can be assigned to each monitored area for monitoring an oxygen concentration level in the monitored area.

A protected area is generally understood as a spatially delimited or respectively enclosed area in which the oxygen concentration is lowered to prevent fire and is regulated within a predetermined range of values. A monitored area is a spatially delimited or respectively enclosed area in which the oxygen concentration is monitored although there is no regulating of inert gas introduction. The monitoring serves solely in determining leaks in the line system, for example, and in the generating of appropriate alarms. A service room in which the inert gas generator is disposed as well as an adjacent room or hallway not containing any components of the oxygen-reducing system can for example be established as a monitored area. The oxygen concentration in these rooms should not be lowered.

The regulating function of evaluating the oxygen concentration signal can insofar be used both to regulate the oxygen concentration in a protected area as well as to monitor in a monitoring area. During monitoring, however, the oxygen concentration signal is only compared to previously defined limits and a failure or alarm signal output if the limits are exceeded or not reached. During the regulating, a comparison is likewise made between a predetermined target value and the actual value of the oxygen concentration, yet the actuator for releasing inert gas is at the same time regulated so as to keep the target value as constant as possible. For example, a valve is opened or closed, or an inert gas generator compressor is switched on or off respectively, in order to start or stop the release of inert gas.

A combination controller incorporating the regulating functions of at least two controller modules can moreover be provided as a controller module. Each of the at least two controller modules can be configured or configurable as a master controller, process controller and/or area controller. The combination controller preferably assumes or incorporates regulating functions of two differently configured controller modules, for example a master controller and a process controller. This implementation of a combination controller can be advantageous in the case of, for example, small systems having one protected area and/or one inert gas generator in which the lesser system complexity allows partial centralization of decentrally distributed regulating functions.

In general, multiple inert gas generators can be assigned to a protected area. Such an allocation makes particular sense when the protected area is especially large. Particularly in the case of large halls which form a single protected area, it can be expedient to allocate a plurality of inert gas generators so as to be able to constantly provide a sufficient amount of inert gas.

Providing a sufficient amount of inert gas can also be achieved by the oxygen-reducing system additionally having one or more inert gas containers in which inert gas, in particular nitrogen, is stored. Alternatively, these inert gas containers can also be assigned to another fire protection system, for example an inert gas extinguishing system. Such an inert gas extinguishing system provides a particularly rapid and greater reduction of the oxygen concentration in the protected area in order to extinguish a fire that has already started. In contrast thereto, the oxygen-reducing system provides a minimal long-term lowering of the oxygen concentration in the protected area in order to prevent a fire from starting.

The inert gas containers are preferably refillable, in particular by means of inert gas provided from the inert gas generator. To that end, the inert gas containers in one preferential embodiment are flow-connected or connectable to at least one inert gas generator via a line system of the oxygen-reducing system.

It can inasmuch be preferentially provided for the inventive control and regulating system to comprise a controller module configured as a fill controller. The fill controller is preferably signal-connected to actuators, in particular controllable valves, of the oxygen-reducing system's line system in order to conduct inert gas from at least one inert gas generator into the at least one inert gas container in a controlled manner.

A pressurized gas cylinder filled or fillable with nitrogen can form the inert gas container. In particular, a plurality of pressurized gas cylinders can be combined to form a bank of cylinders. The cylinder bank is preferably connected to the line system of the oxygen-reducing system and has one or more control valves signal-connected to at least one controller module, in particular the fill controller.

Furthermore, the at least one inert gas container and/or the cylinder bank can be assigned at least one temperature sensor and/or at least one pressure sensor. The temperature sensor and/or the pressure sensor is/are preferably signal-connected to a controller module, in particular the fill controller, in order to monitor a (re)filling of the inert gas container/cylinder bank with inert gas and preferentially control/regulate a pressure-compensated and temperature-compensated filling.

The fill controller can be provided by appropriately configuring a standardized controller module. The supplementing of an oxygen-reducing system with one or more additional inert gas containers or the augmenting of an oxygen-reducing system with a fill controller as a supplement to an inert gas extinguishing system is insofar an option that can be offered on a customer-specific basis. Due to the controller modules' modularity, this option can be easily realized during the on-site installation of the oxygen-reducing system at the customer. In any case, the control and regulating system can be configured by simple user input such that one of the controller modules can be assigned the regulating functions of a fill controller.

A master controller, if provided as the case may be, serves to coordinate the controller modules, particularly the area controller and/or process controller and/or combination controller, respectively assigned to the protected areas and/or monitored areas. The master controller is preferably connected to the area controllers and process controllers via a ring bus system, whereby the master controller effects communicative coordination between the further controller modules. The master controller can thus assign priorities for the activation of the individual inert gas generators. To that end, the master controller can for example receive a request for inert gas from an area controller which has identified an increase of oxygen concentration in a protected area. Based on the utilization of the individual inert gas generators, the master controller can then actuate that process controller which is assigned to the inert gas generator having the shortest operating time. Doing so enables optimizing inert gas generator utilization.

The process controller can be signal-connected to the inert gas generator so as to regulate inert gas generation. Alternatively or additionally, the area controller can be signal-connected to the oxygen concentration sensor so as to regulate oxygen concentration in a protected area. The master controller can be signal-connected to the process controller and the area controller in order to provide and/or monitor higher-order controller communication. The cited regulating functions are thus distributed across the process controller, the area controller and the master controller. The distribution can, however, vary dynamically during the operation of the control and regulating system. For example, the area controller can become a process controller and/or the process controller can at least partly assume the functions of the master controller. This is made possible by the de-centralized structure and the modular allocation of individual regulating functions.

The master controller, or the controller module configured as a master controller respectively, can be configured or configurable so as to receive failure and/or alarm messages from the area controller and/or the process controller and/or the combination controller and pass them on collectively to a user interface or man/machine interface respectively, for example to a control unit or control panel and/or an external failure and/or alarm reporting component. Doing so enables central monitoring of the failure and alarm messages, for example by control centers or security operations.

The individual controller modules are preferably arranged at a spatial separation from one another. This serves the system stability since physical impact to individual controller modules can only result in spatially limited malfunctions. These malfunctions can be counterbalanced, for example by other controller modules taking over regulating functions. The spatial distribution of the controller modules additionally enables better accessibility to same as well as shorter line routes between the controller modules and the components of the oxygen-reducing system.

A further increase in operational reliability is achieved by the controller modules preferably being dynamically configurable during operation. Particularly a first controller module can thereby assume one or more regulating functions of a second controller module. Conversely, the second controller module can also assume one or more of the regulating functions of the first controller module. Thus, should the first controller module fail, for example, the second controller module can take over its regulating function(s) so that the functional reliability of the control and regulating system as a whole continues to be ensured. The regulating function can thereby be assumed automatically and optionally in the context of standby redundancy, cold redundancy or hot redundancy so as to continuously guarantee the maximum operational reliability. It is thereby not absolutely imperative for the two controller modules which exchange regulating information with each other, or take over for one another respectively, to have been originally designed as redundant controller modules. In fact, a controller module which initially performs one or more other regulating functions can also assume an additional regulating function of a further controller module in order to at least partially compensate for its failure. One important condition for the dynamic configuration and assuming of regulating functions from other controller modules is a signal connection, and if applicable also energy-supplying connection, of the assuming controller module to the sensors and actuators of the surrendering controller module. This connection can for example be made via the connecting paths of the surrendering controller module as well as between the assuming and surrendering controller module or can be designed as an additional redundant connection between the assuming controller module and the sensors and actuators of the surrendering controller module.

Thus, a first controller module can initially perform the regulating function of evaluating an oxygen concentration signal, for example. A second controller module can realize the control or regulation of the inert gas generator as a process controller. The first and second controller modules thus reciprocally act in standby redundancy. Should the first controller module fail, the second controller module can take over the failed function, in the present case the evaluation of an oxygen concentration signal from the oxygen concentration sensor, in order to continue to ensure the operational reliability of the entire control and regulating system. It is also conceivable for the second controller module to not assume any additional function in the strict sense upon failure of the first controller module but rather expand its functions to the protected area of the first controller module; i.e. incorporate a further protected area into the regulation. Likewise, a process controller can for example extend its process regulating function to a further inert gas generator. The dynamic configurability of the individual controller modules achieves a particularly high degree of operational reliability with minimal installation effort.

The dynamic configuration of the controller modules during operation can be initiated not only upon failure of a controller module but can also for example contribute to a more even utilization of the controller modules. For example, energy resources can be saved by putting a controller module with actively low utilization into a sleep mode of low energy consumption and another controller module assuming the regulating functions of the controller module in sleep mode.

Alternatively or additionally, operational reliability can thereby also be ensured by two controller modules having an identical range of functions and being signal-connected to one another so as to form an inherently redundant controller group. Even if the controller modules are dynamically configurable during operation and thus each controller module is able to take over a regulating function of another controller module that was not initially assigned to the first controller module, additional operational reliability can still be ensured by means of redundant controller groups. Thus, for example, two controller modules can be of identical design or have an identical range of functions respectively. In particular, two controller modules, each having been initially assigned the same regulating functions, can be signal-connected to each other. Thus, for example, two controller modules, each being designed as an area controller and performing the regulating functions of activating the actuator to release inert gas, can be interconnected into a redundant controller group by one or the other controller module controlling the actuator. Should one of the two area controllers fail, the actuator for releasing inert gas is then activated by the other area controller of the redundant controller group. To improve energy efficiency, a controller module of the redundant controller group can be put into a sleep mode until it receives a signal to take over the regulating functions of the other controller module.

It can thus be specifically provided in a further development of the invention for the controller modules, in particular the controller modules of a controller group, to each be configured and signal-connected to one another such that a controller module automatically takes over the regulating function of another controller module should same experience failure and/or overload. The assuming of a regulating function in the event of a controller module failure serves the operational reliability of the control and regulating system of the oxygen-reducing system. Alternatively or additionally, however, the control and regulating system can also be adapted such that the controller modules automatically assume the regulating functions of another controller module should same experience overloading. So doing can optimize the utilization of the individual controller modules. All in all, a particularly high degree of efficiency can thus be achieved with relatively few controller modules. This improves, among other things, the energy efficiency of the oxygen-reducing system as a whole.

In order to ensure efficient and fast communication between the individual controller modules, it is preferentially provided for the controller modules to be signal-connected to each other through a bus system. The bus system is preferably designed as a ring bus system so as to enable communication channel redundancy. Particularly high system stability is achieved with the ring bus system since communication is rendered possible over redundant paths. Thus, a loss of communication between two controller modules can be compensated for by establishing communication via the other controller modules. In order to be able to connect the controller modules to the bus system, it is preferential for all the controller modules to have identical bus interfaces.

A further advantage achieved with the bus system, in particular the ring bus system, is a reciprocative monitoring of the individual controller modules. The standardized communication interface between the individual controller modules enables the controller modules to monitor each other's status. This enables quickly identifying a controller module's failure or malfunction. As a result, another controller module can take over the function of the failed or respectively malfunctioning controller module. Monitoring of the individual controller modules can for example ensue by the individual controller modules emitting status signals at predetermined intervals of time. The individual controller modules can inasmuch send "signs of life."

The bus system can be realized e.g. via an Ethernet connection with standard protocols such as TCP/IP, Modbus/TCP, UDP, EtherCAT or Powerlink. Such a standardized communication interface further reduces the costs for the manufacture and installation of the control and regulating system.

A further preferential embodiment of the invention can provide for individual or all of the controller modules being coupled to the at least one oxygen concentration sensor and/or to the at least one actuator for releasing inert gas and/or to the at least one inert gas generator via a further bus system. In general, individual or all of the sensors, actuators and/or inert gas generators can be coupled to one or more controller modules via a further bus system particularly suited to the field level. Particularly the at least one oxygen concentration sensor but also the gas, temperature and/or pressure sensors as well as door contacts can be integrated into the further bus system. It can thereby be particularly provided for the further bus system to be a field bus system, preferably of ring and/or stub and/or star topography. The further bus system can use a CAN bus or an RS-485 with CANopen, Profibus or Modbus RTU protocol, for example.

The controller modules can further be signal-connected or signal-connectable to a data storage and evaluation unit so as to make feasible long-term storage and evaluation of system data, in particular control parameters, sensor data, environmental data, energy consumption data and/or status, failure and alarm messages. Doing so thus enables long-term evaluation, for example for predictive maintenance or the determining of relevant maintenance intervals respectively. To that end, statistical methods, for example, can be used in order to evaluate the stored control parameters accordingly. The stored control parameters can additionally be compared to one another at different points in times, for example, in order to receive early warning of changes in the inert gas generators. Lastly, the stored data can also be used for drift compensation so that the control and regulating system can be adapted to gradual environmental changes, for example the degree of contamination and/or varying degrees of purity to the operating materials as supplied.

It is furthermore advantageous for the controller modules to be able to be serviced and/or configured remotely, in particular via an internet connection. In general, the control and regulating system can be equipped with a communication component for external communication, e.g. for remote diagnosis or remote configuration. Remote maintenance via internet connection in particular results in reduced maintenance costs.

With regard to the controller modules, it can preferentially be provided for each of same to have a peripheral recognition function so that the type and mode of operation of oxygen concentration sensors and/or actuators and/or other sensors connected to the respective controller module can be automatically recognized. In other words, the controller modules enable plug-and-play connection of external sensors or actuators.

The controller modules can thereby in particular be of self-configuring design so that regulating functions are automatically activated and/or deactivated based on the respective type and mode of operation of the connected oxygen concentration sensors and/or actuators and/or further sensors. For example, the type of inert gas generator which is connected to the controller module can be recognized from volumetric flow measurements or pressure measurements and/or the number or type of connected valves. Preconfigured settings for this type of inert gas generator can accordingly be retrieved. Alternatively or additionally, the self-configuration is effected via interface recognition. The controller module does not thereby directly recognize the connected sensor or actuator but rather its input/output interface. Since the sensors and actuators each use specific types and/or a specific number of interfaces for input and output data, they can be reliably identified. Self-configuration greatly simplifies the installation of the control and regulating system. Moreover, the control and regulating system is very easy to maintain since replaced components are automatically recognized.

In order to achieve good utilization of the oxygen-reducing system while concurrently ensuring a high level of operational reliability, it is preferential for the at least one controller module, in particular the process controller and/or the master controller, to be configured such that the inert gas is distributed according to predetermined criteria. The at least one controller module can in particular be configured to the effect of regulating the generation of inert gas in each of the inert gas generators such that the inert gas generators run for essentially the same length of time. Upon receiving an inert gas request, the inert gas generator with the shortest operating period is preferably activated thereto. The equalizing of the operating times increases system stability and ensures good utilization of the control and regulating system. Furthermore, the inert gas generators can be serviced at the same time or, respectively, their load-dependent degrading components such as membranes or carbon molecular sieves can be replaced at the same time, this reducing the efforts expended in maintaining the oxygen-reducing system.

A supplementary aspect of the invention relates to an oxygen-reducing system, in particular a fire protection system, having a control and regulating system as described above.

Also specified within the scope of the present application is a method for controlling and/or regulating an oxygen-reducing system, in particular an oxygen-reducing system as described above, wherein one or more controller modules are configured to perform at least one of the following regulating functions:

control/regulation of the inert gas generator, evaluation of an oxygen concentration signal of the oxygen concentration signal sensor, and activation of the actuator to release inert gas.

Different regulating functions are thereby assigned to the individual controller modules during operation, whereby should one controller module fail, another controller module automatically takes over its regulating function.

Figure 1B:
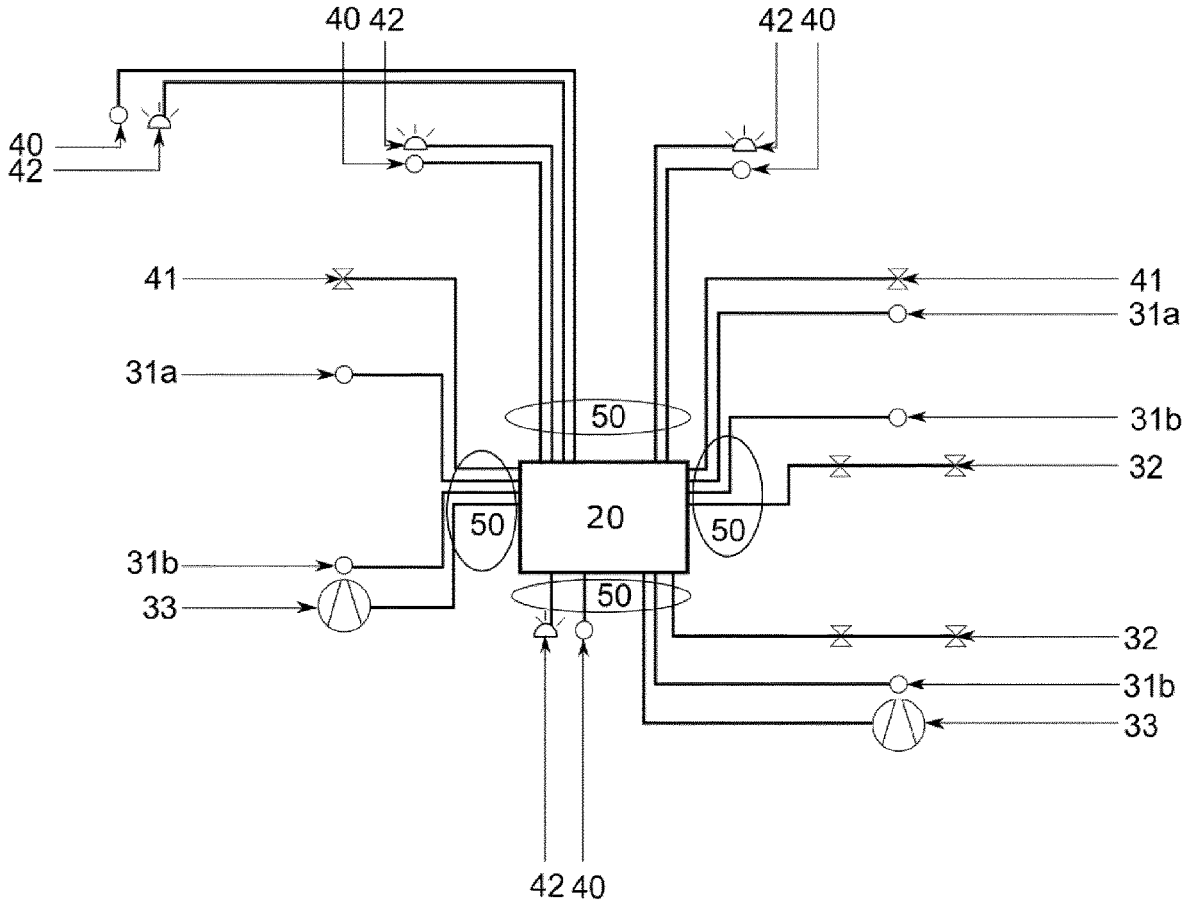
Fig. 1b Prior Art
Figure 2A:
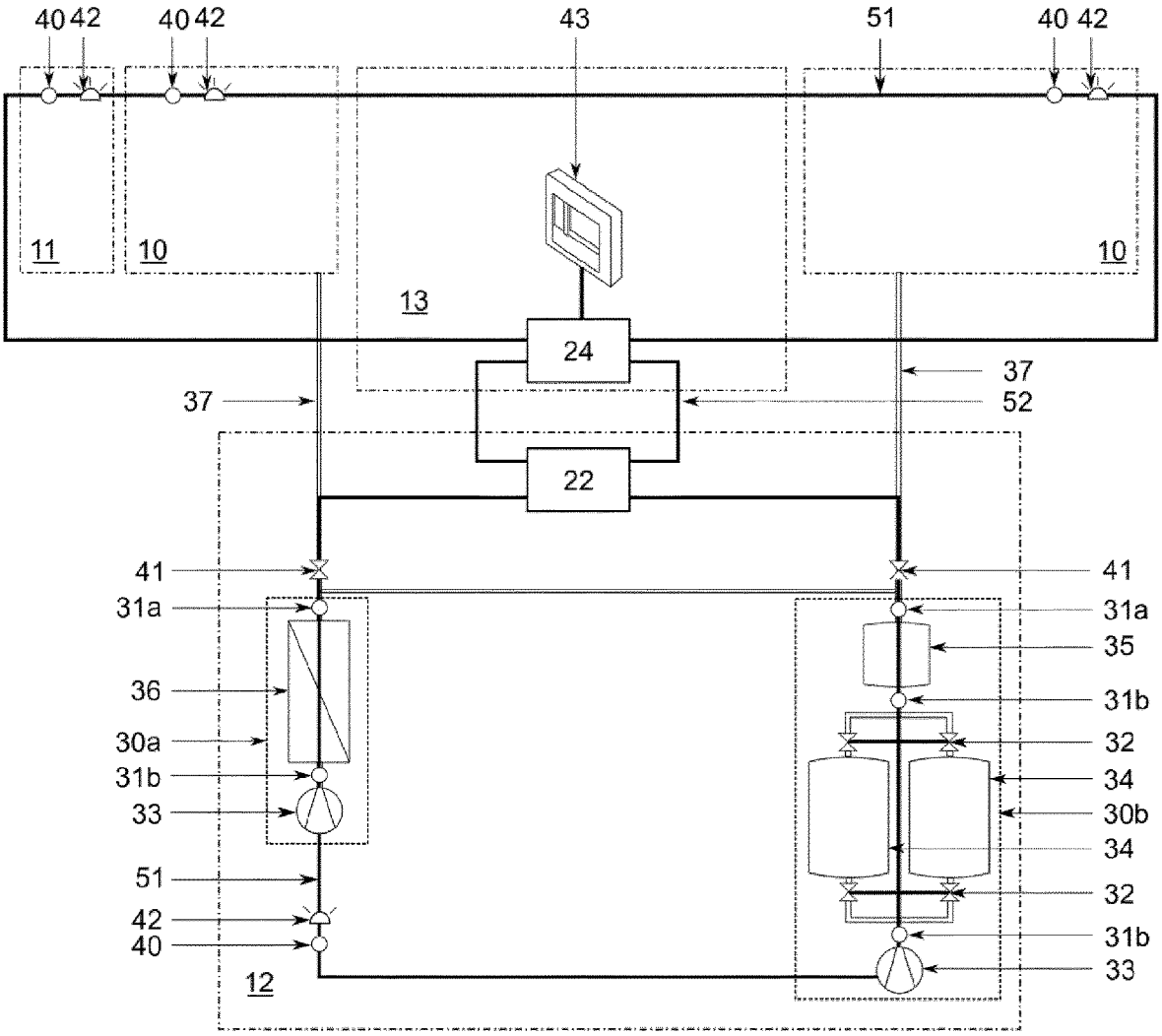
Figure 2B:
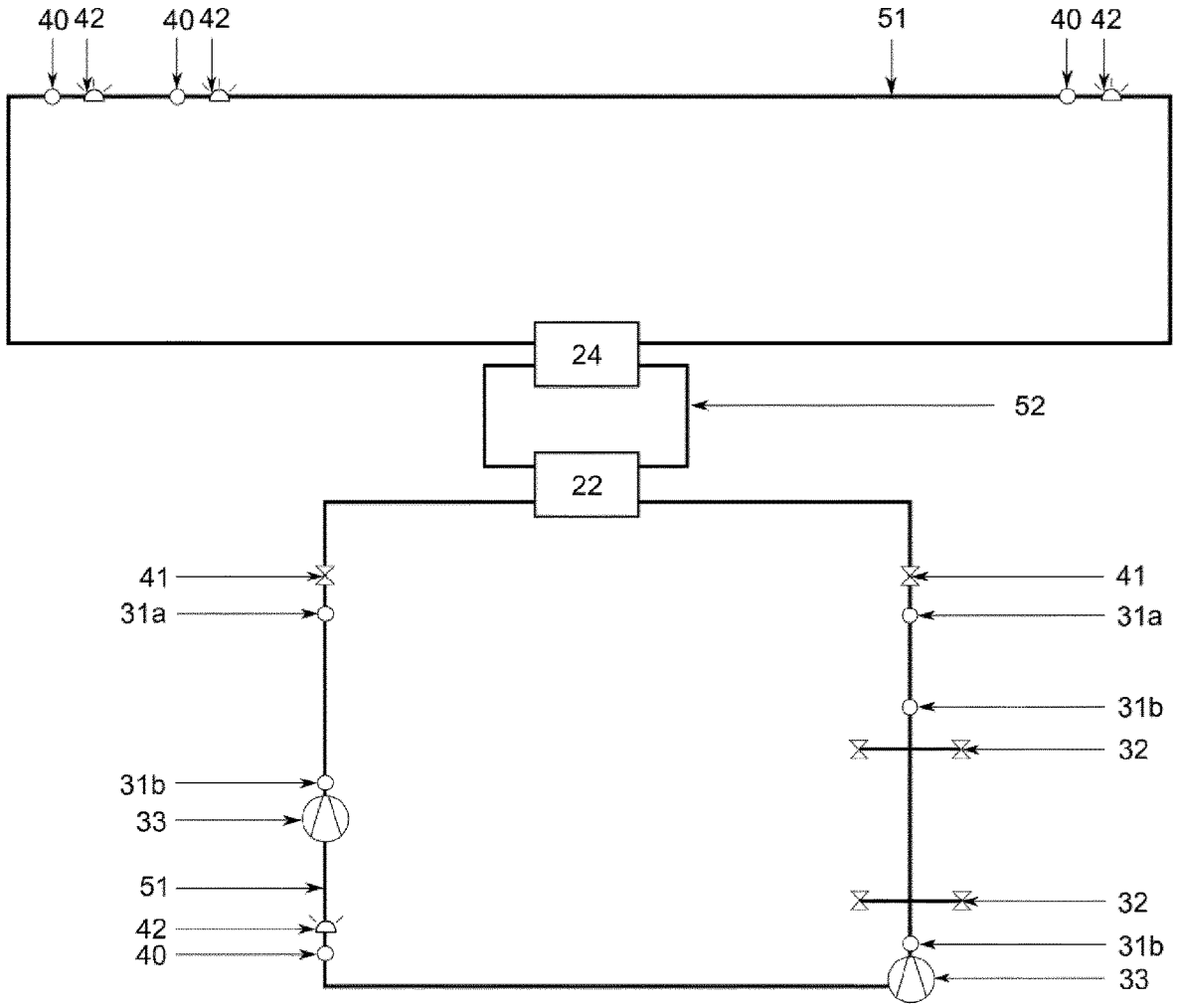
Figure 3A:
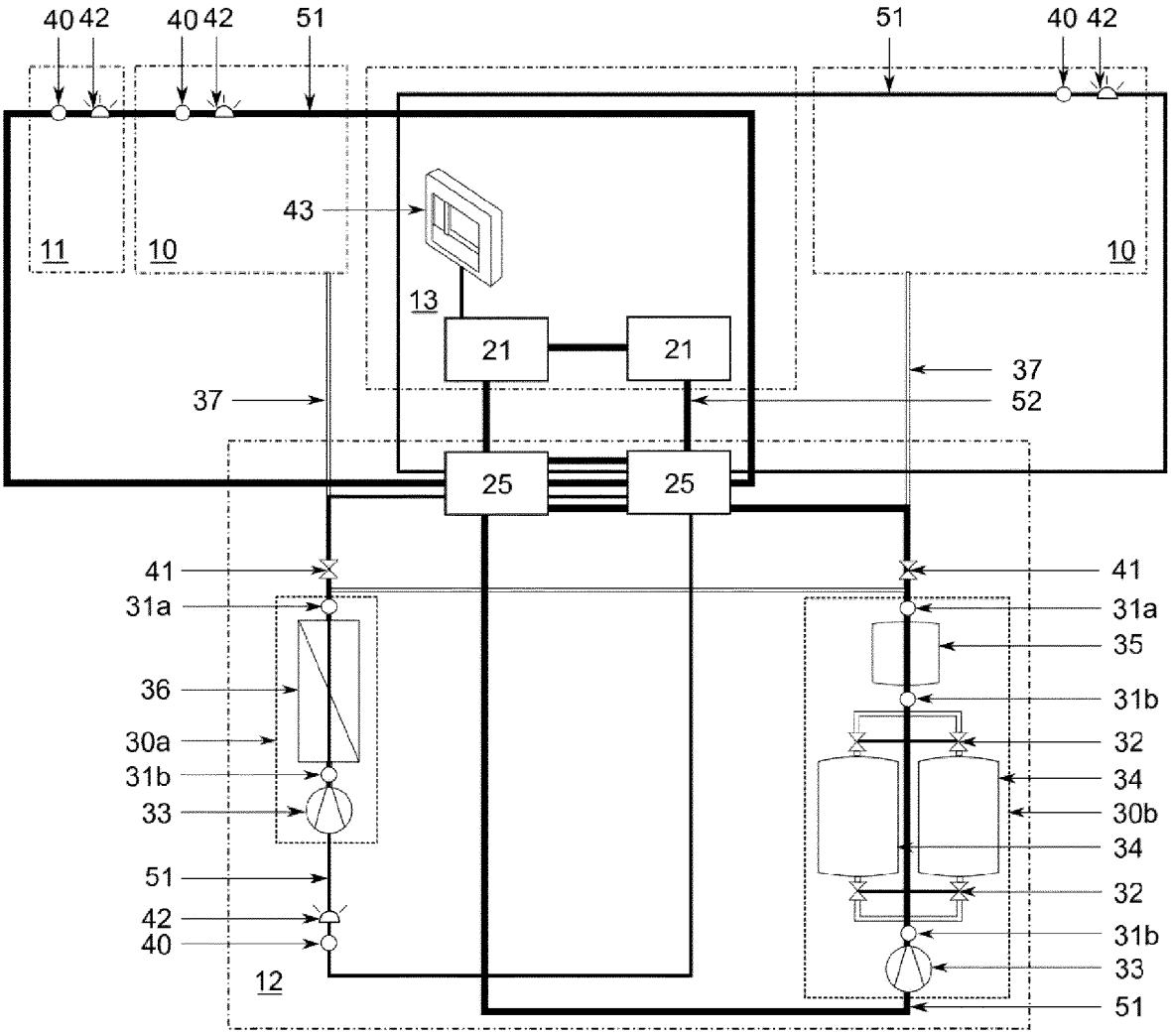
Figure 3B:
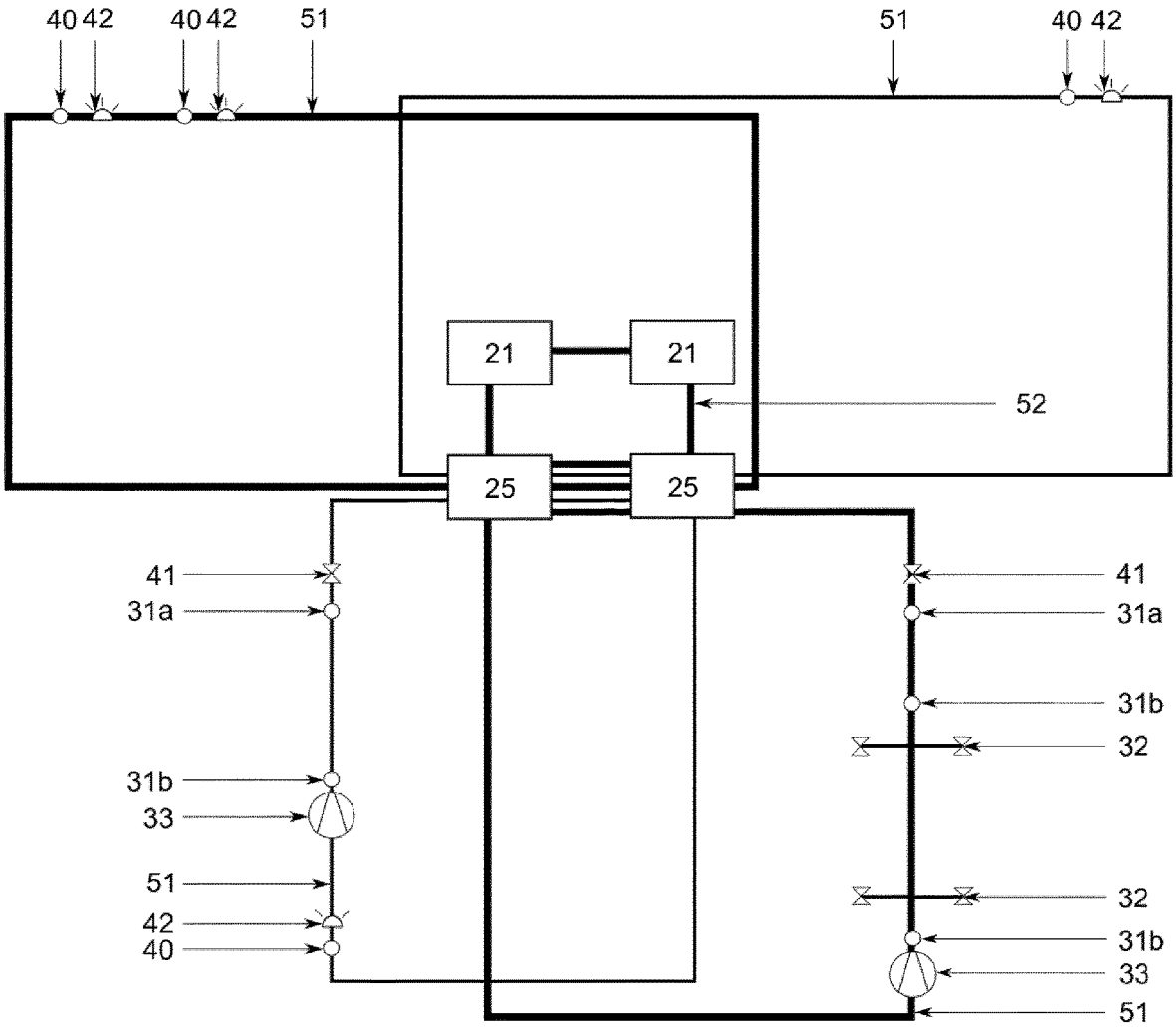
Figure 4A:
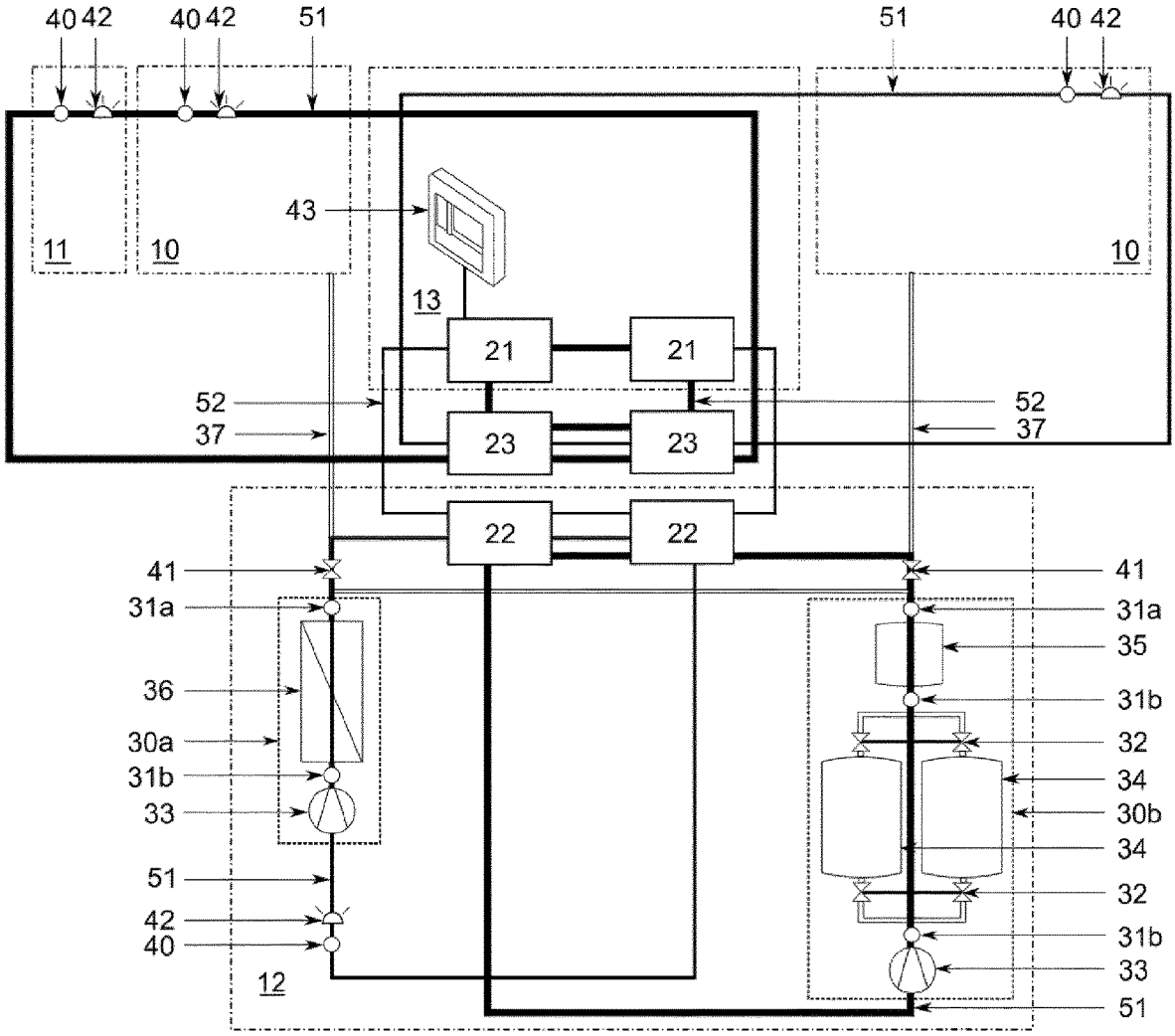
Figure 4B:
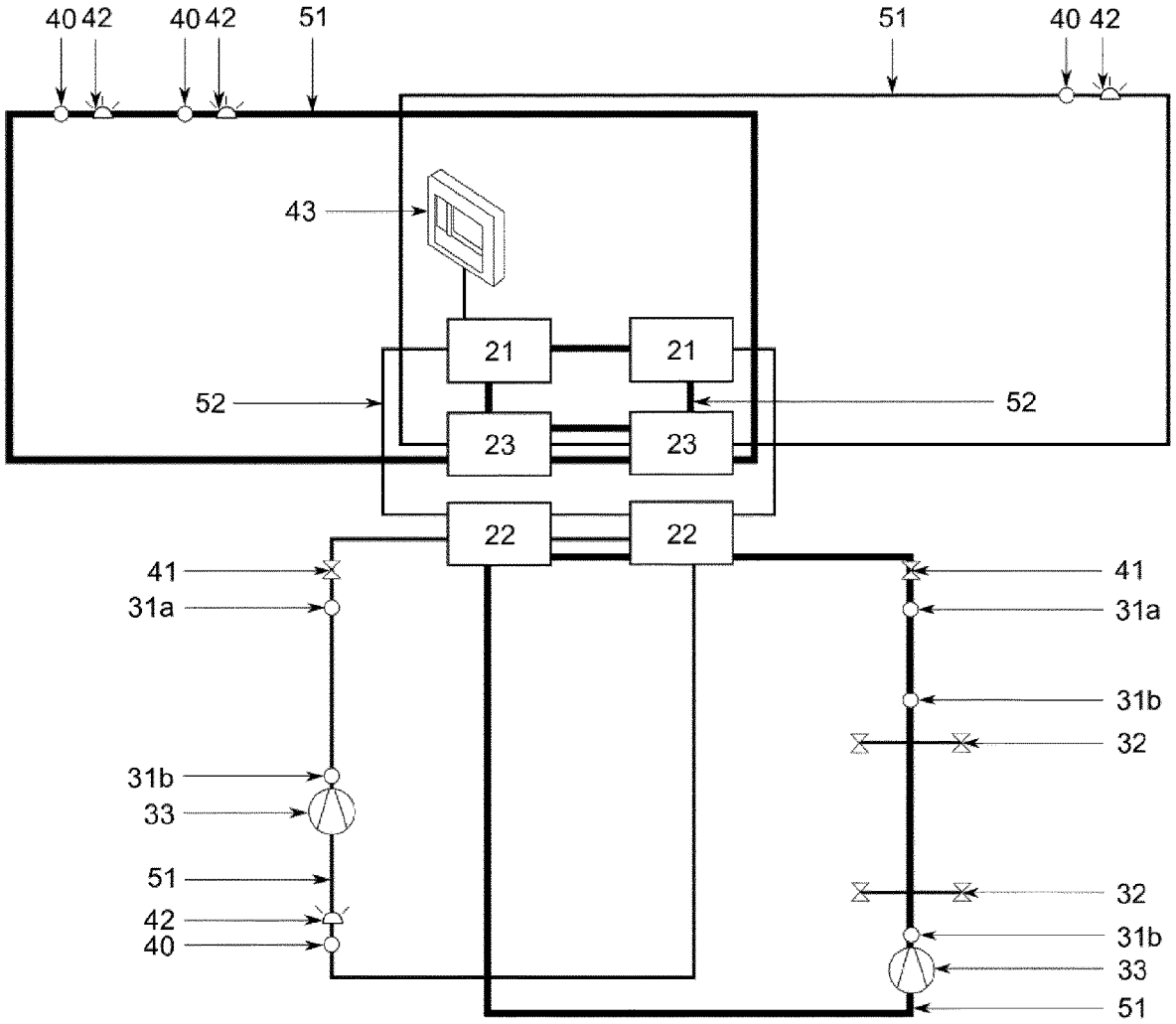
Figure 5A:
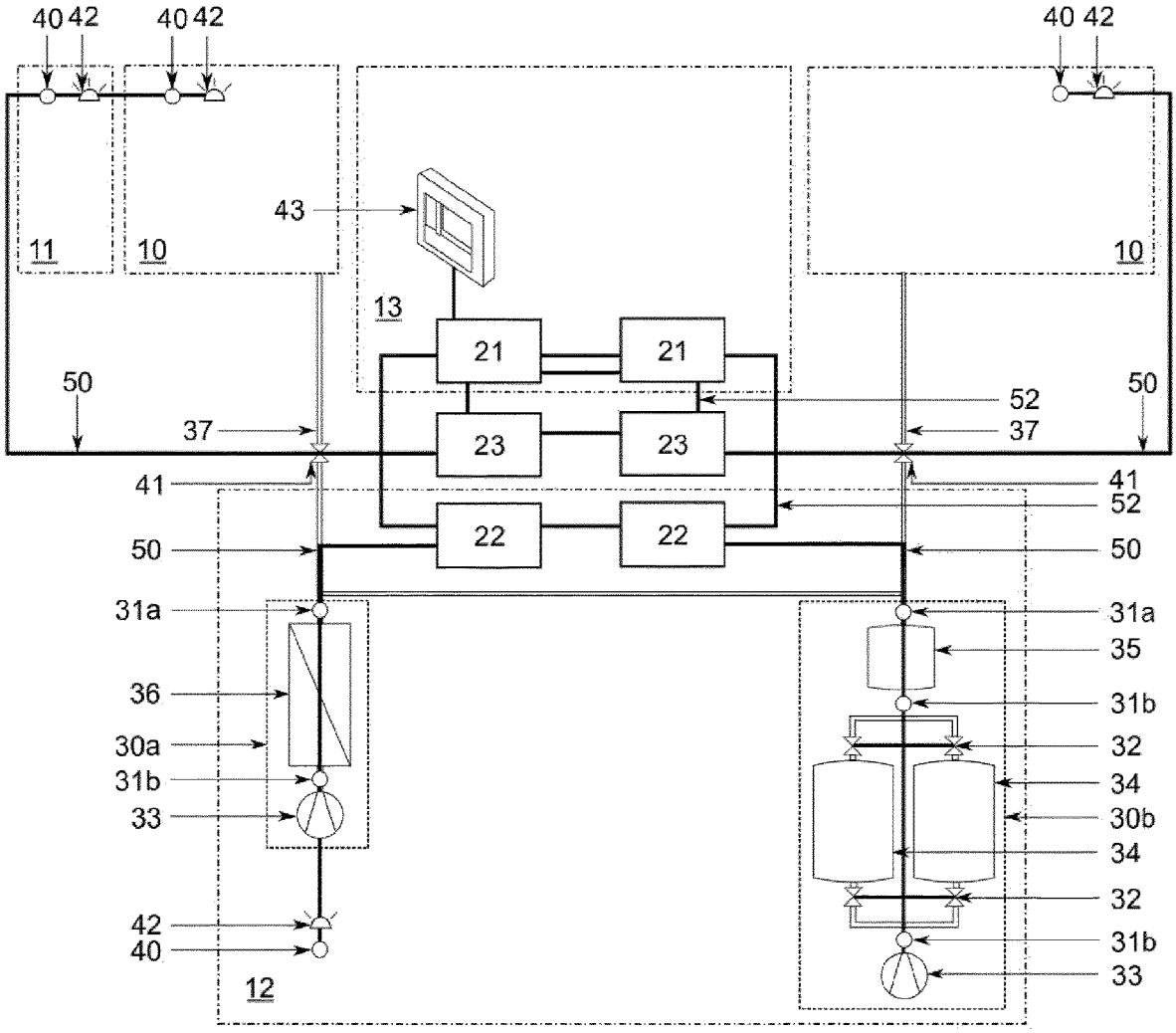
Figure 5B:
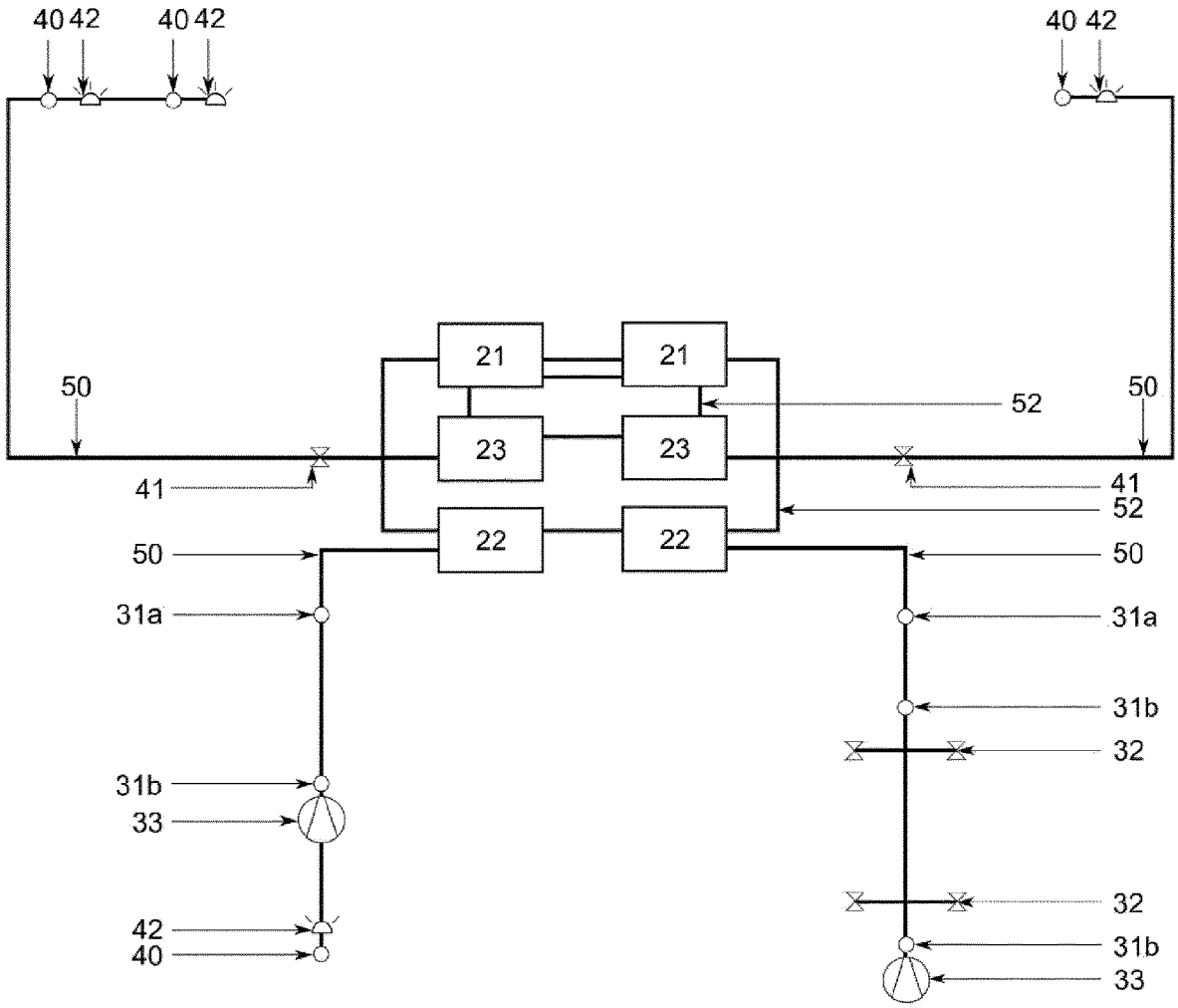
Figure 6:
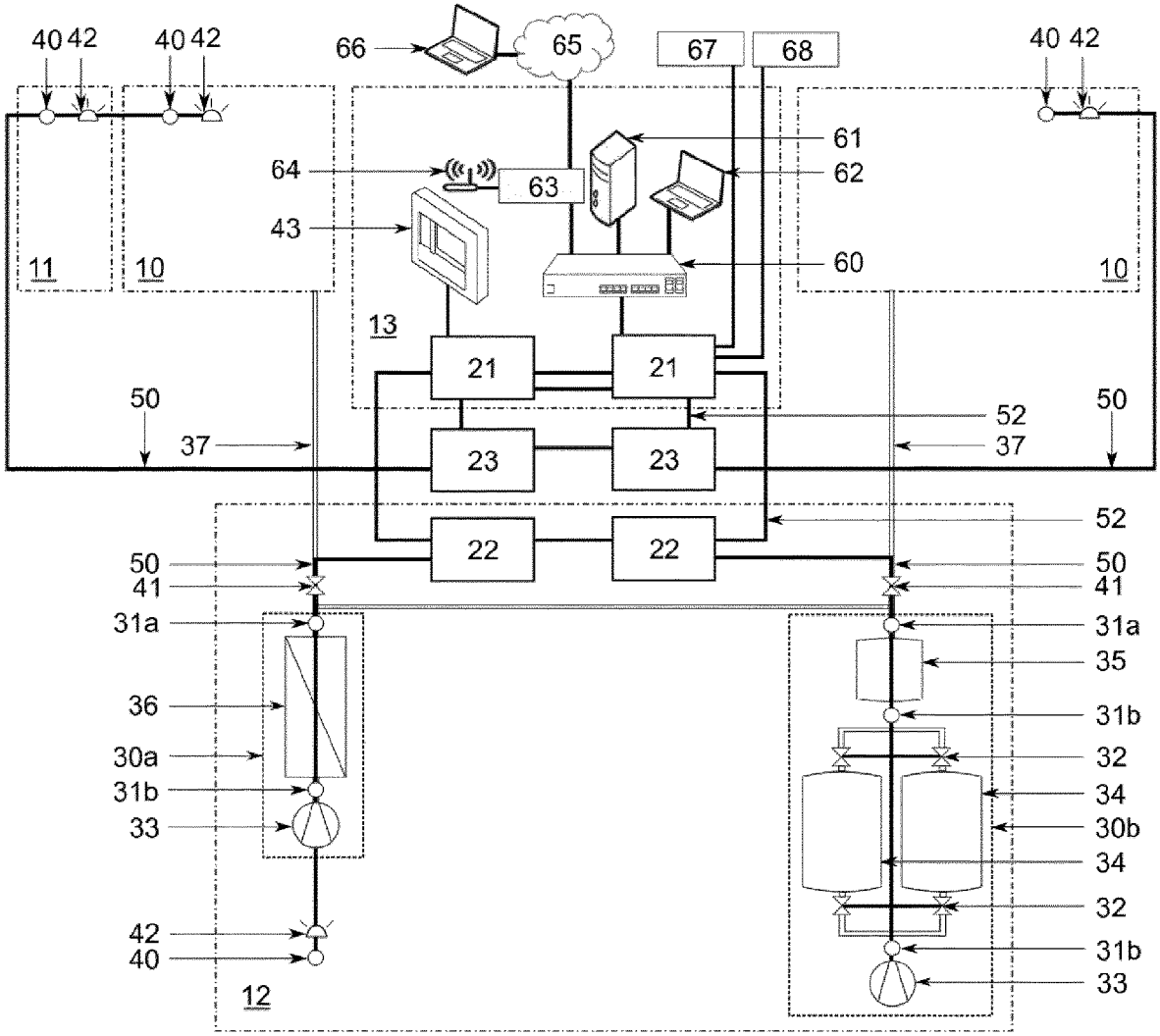

The invention will be explained in greater detail below on the basis of the accompanying schematic drawings. Shown therein:

FIG. 1*a* a schematic representation of an oxygen-reducing system having a control and regulating system pursuant to the prior art;

FIG. 1*b* a schematic representation reduced to the signal connections of a control and regulating system of an oxygen-reducing system pursuant to the prior art;

FIG. 2*a* a schematic representation of an oxygen-reducing system having a control and regulating system according to the invention pursuant to one preferential embodiment with two controller modules;

FIG. 2*b* a schematic representation reduced to the signal connections of an inventive control and regulating system of an oxygen-reducing system pursuant to one preferential embodiment with two controller modules;

FIG. 3*a* a schematic representation of an oxygen-reducing system having an inventive control and regulating system pursuant to a further preferential embodiment with four controller modules;

FIG. 3*b* a schematic representation reduced to the signal connections of an inventive control and regulating system of an oxygen-reducing system pursuant to one preferential embodiment with four controller modules;

FIG. 4*a* a schematic representation of an oxygen-reducing system having an inventive control and regulating system pursuant to a further preferential embodiment with six controller modules;

FIG. 4*b* a schematic representation reduced to the signal connections of an inventive control and regulating system of an oxygen-reducing system pursuant to one preferential embodiment with six controller modules;

FIG. 5*a* a schematic representation of an oxygen-reducing system having an inventive control and regulating system pursuant to a further preferential embodiment with six controller modules and field stub lines;

FIG. 5*b* a schematic representation reduced to the signal connections of an oxygen-reducing system having an inventive control and regulating system pursuant to a further preferential embodiment with six controller modules and field stub lines; and FIG. 6 a schematic representation of an oxygen-reducing system having an inventive control and regulating system pursuant to a further preferential embodiment with enhanced communication.

FIGS. 1*a*, 2*a*, 3*a*, 4*a*, 5*a* and 6 basically show similarly structured oxygen-reducing systems which serve as preventive fire protection systems for monitoring and regulating the oxygen concentration in protected areas 10. The most important components of the oxygen-reducing system are inert gas generators 30*a*, 30*b*. The inert gas generator 30*a* in the figures is realized as a membrane nitrogen generator and essentially comprises:

a compressor 33 for compressing ambient air;

a pressure sensor 31*b* for detecting the pressure of the compressed ambient air;

a membrane 36 for separating the ambient air into oxygen-enriched air, which is discharged via a not-shown line, and nitrogen-enriched air, which is introduced into one of the protected areas 10 via a nitrogen line 37; and an oxygen concentration sensor 31*a* for measuring the residual oxygen content of the nitrogen-enriched air.

Instead of or in addition to the oxygen concentration sensor 31*a*, a volumetric flow sensor can optionally be provided downstream of the membrane 36.

The inert gas generator 30*b* in the figures is realized as a pressure swing adsorption nitrogen generator and essentially comprises:

a compressor 33 for compressing ambient air;

a pressure sensor 31*b* for detecting the pressure of the compressed ambient air;

an adsorbent container 34, for example having a carbon molecular sieve, for separating the ambient air into oxygen-enriched air, which is discharged via a not-shown line, and nitrogen-enriched air, which is introduced into one of the protected areas 10 via a nitrogen line 37; and a buffer tank 35 for the temporary storage of the nitrogen-enriched air;

valves 32 for alternatingly feeding the ambient air into the adsorbent container 34 or the nitrogen-enriched air from the adsorbent container 34 into the buffer tank 35 respectively;

a pressure sensor 31*b* for detecting the pressure of the nitrogen-enriched air; and an oxygen concentration sensor 31*a* for measuring the residual oxygen content of the nitrogen-enriched air.

Instead of or in addition to the oxygen concentration sensor 31*a*, a volumetric flow sensor can optionally be provided downstream of the buffer tank 35.

The nitrogen-enriched air generated by the inert gas generators 30*a*, 30*b* is introduced as needed into the protected areas 10 via selector valves 41 in order to lower the oxygen content of the air in the protected areas 10. The oxygen content in the protected areas 10 as well as also in, for example, monitored rooms 11, e.g. in an adjacent hallway or in machine rooms 12 in which the inert gas generators 30*a*, 30*b* are located, is monitored by oxygen concentration sensors 40. In the event of critical environmental conditions, for example an oxygen content falling below a threshold value, a means of alarm 42 is activated in the affected area and potentially also in other areas in order to alert any persons who might be present. Of course, further sensors, e.g. temperature, moisture and gas sensors, are also conceivable in the protected areas 10, monitored areas 11 and machine rooms 12 as well as on the inert gas generators 30*a*, 30*b*. Other types of actuators, such as actuating drives, can likewise be part of the oxygen-reducing system. Control and regulating functions of the oxygen-reducing system can be monitored and governed via a control panel 43 as a human/machine interface.

FIGS. 1*a* to 6 show different control and regulating systems for enabling the operation of the oxygen-reducing system. FIGS. 1*a*, 2*a*, 3*a*, 4*a* and 5*a* thereby show the control and regulating systems in conjunction with the further components of the oxygen-reducing system. In contrast, FIGS. 1*b*, 2*b*, 3*b*, 4*b* and 5*b* only show the signal connections of the control and regulating systems to sensors and actuators. They thereby serve in providing a better overview of the architecture of the respective control and regulating system.

FIGS. 1*a* and 1*b* show a control and regulating system of an oxygen-reducing system pursuant to the prior art. Such systems for oxygen-reducing systems have to date been realized with a control center 20 connected in a star layout to the individual sensors 31*a*, 31*b*, 40, actuators 32, 33, 41 and means of alarm 42 by means of field stub lines 50. As can be clearly seen from FIGS. 1*a* and 1*b*, the individual connections between the control center 20 and the sensors 31*a*, 31*b*, 40, actuators 32, 33, 41 and alarm means 42 result in a complex architecture of lines with, inter alia, a large number of individual lines, long line lengths and resulting increased susceptibility to failure. The control center 20 itself needs to be configured with high computing power and numerous interfaces in order to be able to reliably perform all the control and regulating functions. Subsequent expansions and reconfigurations, as well as troubleshooting in the event of failure messages, prove laborious as well as time-consuming and costly.

FIGS. 2*a* to 6 show variants of the control and regulating system according to the invention. All the exemplary embodiments of the invention comprise at least two controller modules 21, 22, 23, 24, 25 to which one or more regulating functions of the control and regulating system are decentrally distributed. The controller modules 21, 22, 23, 24, 25 are preferably of standardized construction, thus essentially having identical hardware components. Each controller module 21, 22, 23, 24, 25 in particular comprises similar or comparable controllers as well as at least partially similar or comparable communication interfaces. The controller modules 21, 22, 23, 24, 25 are signal-connected to one another and are preferably of differing configuration. In particular, different regulating functions can be divided among the individual controller modules 21, 22, 23, 24, 25.

The exemplary embodiment according to FIGS. 2*a*, 2*b* shows for example a control and regulating system having two controller modules 22, 24. A combination controller 24 which combines the regulating functions of an area controller and a master controller is thereby in particular provided and, as a consequence, takes over the monitoring of the oxygen concentration levels in the protected areas 10 on the one hand and, on the other hand, the coordination of the communication between the controller modules 22, 24 and the further components of the oxygen-reducing system. The further controller module is a controller module configured as a process controller 22 for controlling or respectively regulating the generation of inert gas by the two inert gas generators 30*a*, 30*b*. The combination controller 24 and the process controller 22 are spatially separated from one another. The process controller 22 is located in the machine room 12 in which the two inert gas generators 30*a*, 30*b* are also arranged. The combination controller 24, on the other hand, is located in a separate utility room 13. The spatial separation of the two controller modules 22, 24 increases system stability, shortens line lengths and improves accessibility to the controller modules 22, 24.

For its area controller function, the combination controller 24 is connected to oxygen concentration sensors 40 and alarm means 42 in the protected areas 10 as well as the monitored area 11. With the aid of the oxygen concentration sensors 40, the combination controller 24 determines the oxygen concentration in the atmosphere of the protected areas 10 and the monitored area 11. As regards the regulation of the oxygen concentration in the protected areas 10, the combination controller 24 communicates a nitrogen requirement to the process controller 22, which adapts the inert gas generation to the communicated nitrogen requirement and coordinates the introduction of the nitrogen-enriched air, for example via activation of the selector valves 41. Alternatively, the selector valves can be activated by an area controller as soon as same detects a demand for nitrogen. The process controller 22 is in turn signal-connected to pressure and oxygen concentration sensors 31*a*, 31*b* as well as actuators such as the compressors 33 and valves 32 of the inert gas generator 30*a*, 30*b* in order to control and regulate the inert gas generation. The process controller 22 is however not limited to the function of the generation of inert gas; in the present exemplary embodiment, it also takes on an area controller function for the machine room 12 by monitoring the oxygen concentration of the machine room 12 via an oxygen concentration sensor 40 and, if necessary, activating a means of alarm 42 in the machine room 12 upon the falling short of an oxygen threshold value suggestive of inert gas generator 30*a*, 30*b* leakage. This highly individual configuration of the controller modules 22, 24, adaptable to a wide variety of requirements, enables the functions of the control and regulating system to be distributed on a need-based and optimal basis in respect of the line architecture.

In contrast to the prior art, the connecting paths between the controller modules 22, 24 and the associated sensors 31*a*, 31*b*, 40, actuators 32, 33, 41 and alarm means 42 are realized as field ring lines 51. The ring-shaped configuration can reduce line paths and the redundant connecting paths furthermore increases system stability. Communication via the field ring lines 51 can ensue for example via a CAN bus or via RS-485 with CANopen, Profibus or Modbus RTU protocol. The combination controller 24 and the process controller 22 additionally communicate via an additional controller ring line 52, realized for example as an Ethernet connection. The combination controller 24 is furthermore in a stub connection with the control panel 43 via which a user can monitor and govern the control and regulating functions.

FIGS. 3*a*, 3*b* show a further exemplary embodiment of the invention, wherein a total of four controller modules 21, 25 are provided. Two respective controller modules form one master controller 21. These are signal-connected to each other, in particular by a controller ring line 52. Two combination controllers 25, which in this exemplary embodiment combine the functions of an area controller and a process controller, are additionally disposed in the controller ring line 52. The master controller 21 and the combination controller 25 are in this case designed as redundant controller modules 21, 25, each forming one respective controller group and providing increased system stability due to the redundant design. The combination controllers 25 are signal-connected to the sensors 31*a*, 31*b*, 40, actuators 32, 33, 41 and alarm means 42 of the inert gas generators 30*a*, 30*b*, the protected areas 10, the monitored area 11 and the machine room 12 via field ring lines 51. They thus coordinate the generation of inert gas by the inert gas generators 30*a*, 30*b* as well as the monitoring and regulating of the oxygen concentration in the individual areas 10, 11, 12. On the other hand, the master controllers 21 in the utility room 13 are responsible for coordinating controller module 21, 25 communication as well as the displaying of failure and alarm messages or respectively receiving user inputs via the control panel 43. The exemplary embodiment according to FIGS. 3*a*, 3*b* is characterized on the whole by high redundancy and thus operational reliability. Should one of the controller modules 21, 25 fail, a controller module 21, 25 not only of the same construction but also the same configuration can take over the entirety of functions of the other controller module 21, 25. Due to the two respective ring lines shared by both redundant controller modules 21, 25, each controller module 21, 25 can directly access the sensors 31*a*, 31*b*, 40, actuators 32, 33, 41 and alarm means 42 of the other controller module 21, 25 without any detour.

FIGS. 4*a*, 4*b* show a similar control and regulating system architecture pursuant to a further preferred exemplary embodiment. Specifically, the control and regulating system according to FIG. 4 likewise comprises two master controllers 21 in utility room 13 which are signal-connected to one another and form a redundant controller group. The master controllers 21 are responsible for coordinating controller module 21, 22, 23 communication as well as the displaying of failure and alarm messages or respectively receiving user inputs via the control panel 43. In contrast to the exemplary embodiment according to FIGS. 3*a*, 3*b*, no combination controller is provided. Instead, the control and regulating system comprises two separate area controllers 23 as well as two separate process controllers 22. The area controllers 23 serve in the monitoring of the oxygen concentration in the protected areas 10 and in the monitored area 11. The area controllers 23 are to this end signal-connected to oxygen concentration sensors 40 in areas 10, 11 and can likewise activate alarm means 42 located in these areas 10, 11 in the event of a malfunction or alarm such as for instance an unhealthy oxygen concentration level. The process controllers 22 serve in the control and regulating of the generation of inert gas by the inert gas generators 30*a*, 30*b* and are to that end signal-connected to the pressure and oxygen concentration sensors 31*a*, 31*b* as well as to the valves 32, the compressors 33 and the selector valves 41. Moreover, in the exemplary embodiment shown, they fulfill an additional area controller function as relates to the machine room 12. The area controllers 23 and the process controllers 22 do not communicate directly with one another but are instead jointly connected to the master controller 21 via two controller ring lines 52. It thereby becomes clear that the master controllers 21 assume the coordinating of the communication, for example processing a nitrogen requirement determined by the area controllers 23 and relaying it to the process controllers 22. The exemplary embodiment according to FIGS. 4*a* and 4*b* is not only characterized by even higher redundancy and system stability compared to the exemplary embodiment in FIGS. 3*a*, 3*b*, but also shows particular suitability for very large or complex oxygen-reducing systems with high control and regulation needs at the inert gas generation, area monitoring and higher-order communication levels.

The exemplary embodiment according to FIGS. 5*a*, 5*b* differs from the exemplary embodiment according to FIGS. 4*a*, 4*b* by the sensors 40 and actuators 42, or inert gas generators 30*a*, 30*b* respectively, being connected to the area controllers 23/process controllers 22. Specifically, field stub lines 50 are provided in this exemplary embodiment instead of field ring lines. This avoids the doubled connection of sensors and actuators and is thus economic by comparison. Moreover, the selector valves 41 are activated by the area controllers 23 in this example.

FIG. 6 shows an enhancement of the exemplary embodiment according to FIGS. 5*a*, 5*b*. Specifically, the control and regulating system is of similar design to the exemplary embodiment according to FIGS. 5*a*, 5*b*. In total, two redundantly designed master controllers 21, two redundantly designed area controllers 23 and two redundantly designed process controllers 22 are provided. The area controllers 23 and process controllers 22 are signal-connected to the master controllers 21 via controller ring lines 52.

FIG. 6 additionally shows further communication interfaces which can be provided on at least one of the master controllers 21. For example, the master controller 21 can have an input interface for a weather station 67. Current environmental conditions of the ambient atmosphere, e.g. wind speeds, can thus be incorporated into the regulation of the oxygen-reducing system. A signal output which communicates with a continuously manned location 68 can furthermore be provided. Doing so enables alarm and failure messages to be forwarded to suitable recipients for effecting countermeasures.

Additional communication functions for remote maintenance or remote configuration can furthermore be provided. For example, a communication switching unit ("switch") 60 controls the communication to different external devices such as for instance a remote diagnosis module 63 which in turn can be connected to an external remote support PC 66 via a WLAN router 64 or via the internet 65 or to a local support PC 62. A likewise locally located data storage and evaluation unit 61, e.g. an industrial PC or server, can serve in the logging of all operational data and in particular in the long-term evaluation of system data such as for instance control parameters, sensor data, environmental data, energy consumption data and/or status, failure and alarm messages. This thereby enables for example predictive maintenance or the determining of relevant maintenance intervals.

In general, the control and regulating system according to the above-described exemplary embodiments can be expanded virtually at will. In particular, multiple master controllers 21, multiple area controllers 23, multiple process controllers 22 and/or multiple combination controllers 24, 25 can be provided.

LIST OF REFERENCE NUMERALS

10 protected area
11 monitored area
12 machine room
13 utility room
20 control center
21 master controller
22 process controller
23 area controller
24 combination controller (master/area controller)
25 combination controller (process/area controller)
30*a* membrane nitrogen generator
30*b* pressure swing adsorption nitrogen generator
31*a* oxygen concentration sensor
31*b* pressure sensor
32 valve
33 compressor
34 adsorbent container
35 buffer tank
36 membrane
37 nitrogen line
40 oxygen concentration sensor
41 selector valve
42 alarm means
43 control panel
50 field stub line
51 field ring line
52 controller ring line
60 switch
61 industrial PC
62 support PC
63 remote diagnosis module
64 WLAN router
65 internet
66 remote support PC
67 weather station
68 continuously manned location

What is claimed is:

1. An oxygen-reducing system configured to lower and maintain an oxygen concentration level in an enclosed protected area, comprising:

an inert gas generator configured to generate inert gas;

an oxygen concentration sensor;

an actuator of the inert gas generator configured to release the generated inert gas;

a plurality of signal-connected controller modules configured to execute one or more regulating functions, wherein the regulating functions are distributed to at least two of the plurality of signal-connected controller modules;

an area controller of the plurality of signal-connected controller modules configured to use the oxygen concentration sensor for one or more of monitoring the oxygen concentration level in an enclosed monitored area or regulating the oxygen concentration level in the enclosed protected area by releasing the inert gas; and a master controller of the plurality of signal-connected controller modules configured to one or more of coordinate communication between components of the oxygen-reducing system or coordinate communication to points external to the oxygen-reducing system, wherein the plurality of signal-connected controller modules are dynamically configurable during operation, and wherein a first controller module is configured to assume execution of one or more regulating functions of a second controller module or vice versa.

2. The oxygen-reducing system of claim 1, wherein the plurality of signal-connected controller modules are modularly combinable with one another, and wherein each signal-connected controller module is differently configured by appropriate user inputs via an input interface.

3. The oxygen-reducing system of claim 1, wherein at least one of the plurality of signal-connected controller modules is further configured to execute regulating functions comprising:

one or more of, (i) regulating the generated inert gas by switching on and off the inert gas generator; (ii) evaluating a sensor signal of one or more of the oxygen concentration sensor, a gas sensor, a temperature sensor, a volumetric flow sensor or a pressure sensor assigned to the inert gas generator, (iii) or activating the actuator of the inert gas generator.

4. The oxygen-reducing system of claim 1, wherein at least one of the plurality of signal-connected controller modules is further configured to execute regulating functions comprising:

evaluating sensor signals selected from one or more of the oxygen concentration sensor, a gas sensor, a temperature sensor, a volumetric flow sensor, or a pressure sensor arranged in one of the enclosed monitored area or the enclosed protected area.

5. The oxygen-reducing system of claim 1, wherein at least one of the plurality of signal-connected controller module is further configured to execute regulating functions comprising evaluating signals from door contacts arranged in one or more of the enclosed monitored area or the enclosed protected area.

6. The oxygen-reducing system of claim 1, wherein at least one of the plurality of signal-connected controller module is further configured to execute regulating functions selected from one or more of:

requisitioning an amount of the inert gas from the inert gas generator;

activating a plurality of actuators in one or more of the enclosed monitored area or the enclosed protected area;

activating displays configured to display oxygen concentration measurement values in one or more of the enclosed monitored area or the enclosed protected area; or activating, in case of alarm, one or more of an acoustic alarm or a visual alarm.

7. The oxygen-reducing system of claim 1, wherein the master controller is further configured to one or more of coordinate communication between components of the oxygen-reducing system or coordinate communication to points external to the oxygen-reducing system, by one or more of, distributing demands for inert gas quantities to a plurality of inert gas generators according to predefined criteria;

distributing the generated inert gas to the enclosed protected area according to the predefined criteria;

collecting and evaluating one or more of a status, a failure or an alarm message of at least one of the plurality of signal-connected controller modules;

generating one or more of the status, the failure or the alarm message for one or more of display on a control panel or forwarding to an external continually manned location;

activating displays to display sensor measurement values; and providing remote access to the oxygen-reducing system.

8. The oxygen-reducing system of claim 1, wherein at least two of the plurality of signal-connected modules have an identical range of functions and are signal-connected to one another so as to form an inherently redundant controller group.

9. The oxygen-reducing system of claim 8, wherein the at least two of the plurality of signal-connected modules of the redundant controller group are each configured to automatically take over one or more functions of each other signal-controller when a respective other signal-connected controller module experiences one or more of failure or overload.

10. The oxygen-reducing system of claim 8, wherein the plurality of signal-connected controller modules and redundant controller groups are arranged at a spatial separation from one another.

11. The oxygen-reducing system of claim 1, wherein the plurality of signal-connected controller modules are one of signal-connected or signal-connectable to a data storage and evaluation unit so as to enable long-term storage and evaluation of system data including one or more of control parameters, sensor data, environmental data, energy consumption data, failure or alarm messages.

12. The oxygen-reducing system of claim 1, wherein the plurality of signal-connected controller modules each have a peripheral recognition function to automatically recognize a type and mode of operation of one or more of oxygen concentration sensors, actuators, or other sensors connected to a respective signal-connected controller module.

13. The oxygen-reducing system of claim 1, wherein the plurality of signal-connected controller modules are self-configuring so that the regulating functions are automatically activated based on one or more of (i) a type and mode of operation of connected devices or (ii) input/output interfaces, the devices selected from one or more connected oxygen concentration sensors or actuators.

14. An oxygen-reducing system configured to lower and maintain an oxygen concentration level in an enclosed protected area, comprising:

an inert gas generator configured to generate inert gas;

an oxygen concentration sensor;

an actuator of the inert gas generator configured to release the generated inert gas;

a plurality of signal-connected controller modules configured to execute one or more regulating functions, wherein the regulating functions are distributed to at least two of the plurality of signal-connected controller modules;

an area controller of the plurality of signal-connected controller modules configured to use the oxygen concentration sensor for one or more of monitoring the oxygen concentration level in an enclosed monitored area or regulating the oxygen concentration level in the enclosed protected area by releasing the inert gas;

a process controller of the plurality of signal-connected controller modules configured to regulate inert gas generation by the inert gas generator, and is a master controller of the plurality of signal-connected controller modules configured to one or more of coordinate communication between components of the oxygen-reducing system or coordinate communication to points external to the oxygen-reducing system.

15. The oxygen-reducing system of claim 14, wherein for each of a plurality of enclosed protected areas, at least one of the plurality of signal-connected controller modules configured as the area controller is assigned to each enclosed protected area for regulating the oxygen concentration level in the respective enclosed protected area.

16. The oxygen-reducing system of claim 14, wherein for each of a plurality of enclosed monitored areas, at least one of the plurality of signal-connected controller modules configured as the area controller is assigned to each enclosed monitored area for monitoring the oxygen concentration level in the respective enclosed monitored area.

17. The oxygen-reducing system of claim 14, wherein a combination controller is configured to perform the regulating functions of at least two of the master controller, the area controller, or the process controller.

18. The oxygen-reducing system of claim 14, wherein one or more of the process controller or the master controller is configured to distribute inert gas according to a predetermined criteria such that multiple inert gas generators run for essentially a same length of time.

19. An oxygen-reducing system configured to lower and maintain an oxygen concentration level in an enclosed protected area, comprising:

an inert gas generator configured to generate inert gas;

an oxygen concentration sensor;

an actuator of the inert gas generator configured to release the generated inert gas;

a plurality of signal-connected controller modules configured to execute one or more regulating functions, wherein the plurality of signal-connected controller modules are self-configuring so that regulating functions are automatically activated based on one or more of (a) a type and mode of operation of connected devices or (ii) input/output interfaces, wherein different regulating functions are assigned to different signal-connected controller modules during operation, and wherein in response to a failure of a first signal-connected controller module, a second signal-connected controller module is configured to automatically take over regulating functions from the first signal-connected controller module;

an area controller of the plurality of signal-connected controller modules configured to use the oxygen concentration sensor to one or more of monitor the oxygen concentration level in an enclosed monitored area or regulate the oxygen concentration level in the enclosed protected area by releasing the inert gas;

a process controller of the plurality of signal-connected controller modules configured to regulate inert gas generation by the inert gas generator; and a master controller of the plurality of signal-connected controller modules configured to one or more of coordinate communication between components of the oxygen-reducing system or coordinate communication to points external to the oxygen-reducing system.

* * * * *